US009745995B2

(12) United States Patent
Jevons

(10) Patent No.: US 9,745,995 B2
(45) Date of Patent: Aug. 29, 2017

(54) RETAINER PLATE

(71) Applicant: ROLLS-ROYCE PLC, London (GB)

(72) Inventor: Matthew Paul Jevons, Derby (GB)

(73) Assignee: ROLLS-ROYCE plc, London (GB)

( * ) Notice: Subject to any disclaimer, the term of this patent is extended or adjusted under 35 U.S.C. 154(b) by 374 days.

(21) Appl. No.: 14/520,683

(22) Filed: Oct. 22, 2014

(65) Prior Publication Data

US 2015/0110634 A1 Apr. 23, 2015

(30) Foreign Application Priority Data

Oct. 22, 2013 (GB) ..... 1318623.4

(51) Int. Cl.

| | |
|---|---|
| ***F01D 5/32*** | (2006.01) |
| ***F04D 29/34*** | (2006.01) |
| ***F01D 5/30*** | (2006.01) |
| ***F04D 19/00*** | (2006.01) |

(52) U.S. Cl.

CPC ..... *F04D 29/34* (2013.01); *F01D 5/3007* (2013.01); *F01D 5/3015* (2013.01); *F01D 5/326* (2013.01); *F04D 19/002* (2013.01); *F05D 2260/30* (2013.01); *F05D 2300/603* (2013.01); *F05D 2300/6012* (2013.01)

(58) Field of Classification Search

CPC ..... F01D 5/3015; F01D 5/32; F01D 5/326; F05D 2260/30

See application file for complete search history.

(56) References Cited

U.S. PATENT DOCUMENTS

| | | | | |
|---|---|---|---|---|
| 5,277,548 | A * | 1/1994 | Klein | F01D 11/008 29/889.21 |
| 5,281,098 | A * | 1/1994 | Glynn | F01D 5/3015 416/220 R |
| 5,624,233 | A | 4/1997 | King et al. | |
| 7,824,157 | B2 * | 11/2010 | Buisson | F01D 5/3015 416/220 R |
| 8,440,276 | B2 * | 5/2013 | Rose | B32B 5/024 428/34.5 |

(Continued)

FOREIGN PATENT DOCUMENTS

| | | |
|---|---|---|
| EP | 0 110 744 A1 | 6/1984 |
| EP | 2 053 199 A1 | 4/2009 |
| GB | 2 262 139 A | 6/1993 |

OTHER PUBLICATIONS

Search Report issued in British Application No. 1318623.4 dated May 23, 2014.

(Continued)

*Primary Examiner* — Ninh H Nguyen

(74) *Attorney, Agent, or Firm* — Oliff PLC

(57) ABSTRACT

A retainer plate is provided for retaining a dovetail root of a fan blade of a gas turbine engine in a corresponding axially-extending slot in the rim of a fan disc. In use, the plate locates in a cavity formed at an end of the slot such that a first side of the plate is arranged for contact with an axial end face of the dovetail root and an opposite second side of the plate is arranged for contact with an abutment surface of the cavity to limit axial movement of the root along the slot. The retainer plate is formed from fiber-reinforced composite material, at least a portion of the composite material being reinforced by 3D-woven fiber tows.

14 Claims, 6 Drawing Sheets

(56) References Cited

U.S. PATENT DOCUMENTS

| | | | | |
|---|---|---|---|---|
| 2009/0226321 | A1 | 9/2009 | Buisson et al. | |
| 2012/0045341 | A1 | 2/2012 | Buisson et al. | |
| 2012/0082559 | A1* | 4/2012 | Guglielmin | F04D 29/388 416/241 R |
| 2013/0111908 | A1* | 5/2013 | Murooka | F01D 5/28 60/726 |
| 2015/0044050 | A1* | 2/2015 | Thomas | F01D 5/147 416/182 |

OTHER PUBLICATIONS

Mar. 9, 2015 Search Report issued in European Application No. 14 18 8731.

* cited by examiner

RETAINER PLATE

FIELD OF THE INVENTION

The present invention relates to a retainer plate for retaining a dovetail root of a fan blade of a gas turbine engine in a corresponding axially-extending slot in the rim of a fan disc.

BACKGROUND OF THE INVENTION

Many aero-engines adopt a dovetail style of fan blade root which locates in a corresponding slot formed in the rim of the fan disc. During service operation, the fan assembly is subject to a complex loading system, consisting of centripetal load, gas-bending and vibration. The dovetail geometry copes particularly well with this kind of loading conditions. Retention devices are fitted to restrain axial movement of fan blades resisting thrust loading under normal running and axial loading during fan blade impact events.

Engine casings must be capable of containing the release of a single compressor or turbine blade, or any likely combinations of blades. In particular, an engine must pass a fan blade-off test to demonstrate mechanical integrity of all systems following the loss of a fan blade. The test is a single-shot exercise, comprising the deliberate release of the portion of a blade outboard of its retention feature at the maximum low pressure shaft speed, either on a full engine or a-fan-blade-off rig.

When the blade is released, it is retained by the casing and is then hit by the following blade, which tends to push the released blade backward (toward the rear of the engine). In reaction, it produces a force pushing the following blade (still retained by the fan disc) forward. The resulting load can be as much as about 80,000 lbf (356 kN) in the axial direction.

Bird impacts on fan blades can also cause axial high loads.

The retention device restraining axial movement of a fan blade must be able to withstand these types of axial load. However, it should also be as light as possible to reduce the weight of the engine.

Shear keys (see e.g. U.S. Pat. No. 5,624,233) and thrust rings (see e.g. GB A 2262139) can be used as retention devices. Another type of retention device takes the form of individual retainer or shear plates positioned at the ends of the fan disc slots.

SUMMARY OF THE INVENTION

An aim of the present invention is to provide an improved retention device to restrain axial movement of fan blades.

Accordingly, in a first aspect, the present invention provides a retainer plate for retaining a dovetail root of a fan blade of a gas turbine engine in a corresponding axially-extending slot in the rim of a fan disc, in use, the plate locating in a cavity formed at an end of the slot such that a first side of the plate is arranged for contact with an axial end face of the dovetail root and an opposite second side of the plate is arranged for contact with an abutment surface of the cavity to limit axial movement of the root along the slot;

wherein the retainer plate is formed from fibre-reinforced composite material, at least a portion of the composite material being reinforced by 3D-woven fibre tows.

A 3D-woven composite material retainer plate can provide significant weight-reduction compared with conventional, typically metallic, shear plates. Alternatively, for the same weight, the strength of the plate can be improved, allowing the plate to withstand greater axial loads. Further, 3D-weaving the reinforcement fibres enhances the ability to vary the alignment of the reinforcing fibres in different parts of the plate depending on the expected stress pattern in the plate.

The retainer plate of the first aspect may have any one or, to the extent that they are compatible, any combination of the following optional features.

The retainer plate may have: a first zone which extends through the thickness of the plate from a region on the first side which contacts with the axial end face of the dovetail root, a second zone which extends through the thickness of the plate from a region on the second side which contacts with the abutment surface of the cavity, and a third zone which extends through the thickness of the plate and separates the first zone from the second zone; wherein the composite material of the first to third zones is reinforced by warp and weft fibre tows which extend in layers parallel to the plane of the plate, and the third zone is also reinforced by angle interlock fibre tows which extend through the thickness of the plate. The third zone typically experiences a high shear stress acting through the thickness of the plate. Advantageously, the angle interlock fibre tows in this zone can be aligned along the direction of the tensile component of the resolved shear stress, to provide a significant increase in resistance to the shear stress.

By "angle interlock fibre tows" we mean tows which would be warp tows if they remained in a given layer of warp and weft tows, but instead, as part of the 3D weaving process, travel through different layers of warp and weft tows, typically from one surface of the eventual plate to the other.

Viewing the retainer plate along the radial direction, the angle interlock fibre tows in the third zone may be angled at between 30° and 60° to the axial direction. For example, viewed along this direction, the angle interlock fibre tows may be angled at about 45° to the axial direction.

The angle interlock fibre tows may be at least 25% and/or at most 75% of the total number of tows in the third zone. For example, the angle interlock fibre tows may be about 50% of the total number of tows in the third zone.

The second zone may also be reinforced by layer-to-layer interlock fibre tows. Advantageously, the layer-to-layer interlock fibre tows in this zone can help to maintain the integrity of the plate, for example when it is being trimmed to shape. The layer-to-layer interlock fibre tows may be at least 2% and/or at most 20% of the total number of tows in the second zone. For example, the layer-to-layer interlock fibre tows may be about 10% of the total number of tows in the second zone.

By "layer-to-layer interlock fibre tows we mean tows which would be warp tows if they remained in a given layer of warp and weft tows, but instead, as part of the 3D weaving process, travel from one layer of warp and weft tows to an adjacent layer and back again.

The portion of the first zone at the first side of the retainer plate may also be reinforced by layer-to-layer interlock fibre tows. Advantageously, the layer-to-layer interlock fibre tows in this portion of the first zone can help to resist delamination of the composite material under high compressive in-plane stresses generated when the plate is loaded by the axial end face of the dovetail root. The layer-to-layer interlock fibre tows may be at least 2% and/or at most 20% of the total number of tows in this portion of the first zone. For example, the layer-to-layer interlock fibre tows may be about 10% of the total number of tows in the layer of this first zone.

Typically the cavity has a pair of abutment surfaces which extend along respective circumferentially-spaced edges of the retainer plate. In this case, the retainer plate may have two second zones, each second zone being located at a respective one of the edges.

The first zone can then be centrally located relative to the second zones, and the retainer plate can have two third zones, each third zone separating the first zone from a respective one of the second zones.

Galvanic corrosion can be a problem particularly when different materials are used for the retainer plate and an adjacent component, such as for a carbon fibre composite material retainer plate and a metal fan disc. The retainer plate may thus have an outer galvanic corrosion protection barrier layer, e.g. at the second side of the plate. The barrier layer may be formed of a polymer matrix composite, such as a glass fibre reinforced composite.

The retainer plate may have a low friction coating on its first side. This can help to reduce fretting damage to the dovetail root. For example, the coating may be a PTFE coating.

The retainer plate may be substantially trapezoidal in shape. In use, the parallel edges of the trapezoid can form radially-spaced inner and outer edges of the plate (the shorter parallel edge generally being the radially outer edge), and the angled edges can form circumferentially-spaced edges of the plate.

In a second aspect, the present invention provides a fan assembly of a gas turbine engine, the assembly having:

a fan disc;

a circumferential row of fan blades, each fan blade having a dovetail root which is retained in a corresponding axially-extending slot in the rim of the fan disc; and a circumferential row of first retainer plates according to the first aspect;

wherein each first retainer plate is located in a cavity formed at an end of a respective one of the slots such that the first side of the first retainer plate is arranged for contact with an axial end face of the respective dovetail root and the opposite second side of the first retainer plate is arranged for contact with an abutment surface of the cavity to limit axial movement of the root along the slot.

The fan assembly may further have:

a circumferential row of second retainer plates according to the first aspect;

wherein each second retainer plate is located in a cavity formed at an opposite end of a respective one of the slots such that the first side of the second retainer plate is arranged for contact with an axial end face of the respective dovetail root and the opposite second side of the second retainer plate is arranged for contact with an abutment surface of the cavity to limit axial movement of the root along the slot.

The first and second retainer plates may have any one or, to the extent that they are compatible, any combination of the optional features of the first aspect discussed above. Further, the fan assembly of the second aspect may have any one or, to the extent that they are compatible, any combination of the following optional features.

The abutment surface of each cavity may be formed as a pair of abutment surface portions which extend along respective circumferentially-spaced edges of the respective retainer plate.

The or each circumferential row of retainer plates may be supported by a respective support ring.

Each fan blade may be radially outwardly chocked in its slot by a respective slider inserted into the slot radially inwardly of the dovetail root. The slider may carry a spring element which urges the fan blade radially outwardly.

At least the dovetail roots of the fan blades may be formed of polymer matrix, fibre reinforced, composite material, such as carbon fibre reinforced composite material. The retainer plates offer advantages over shear key approaches for restraining axial movement of composite material fan blades. In particular, shear keys generally require slots to be formed in the dovetail root, which on a composite blade may sever fibres in the root. The retainer plates, in contrast, act on the axial end faces.

In a third aspect, the present invention provides a gas turbine engine having the fan assembly of the second aspect.

The fan assembly may have any one or, to the extent that they are compatible, any combination of the optional features of the second aspect discussed above.

BRIEF DESCRIPTION OF THE DRAWINGS

Embodiments of the invention will now be described by way of example with reference to the accompanying drawings in which.

DETAILED DESCRIPTION AND FURTHER OPTIONAL FEATURES OF THE INVENTION

Figure 1:
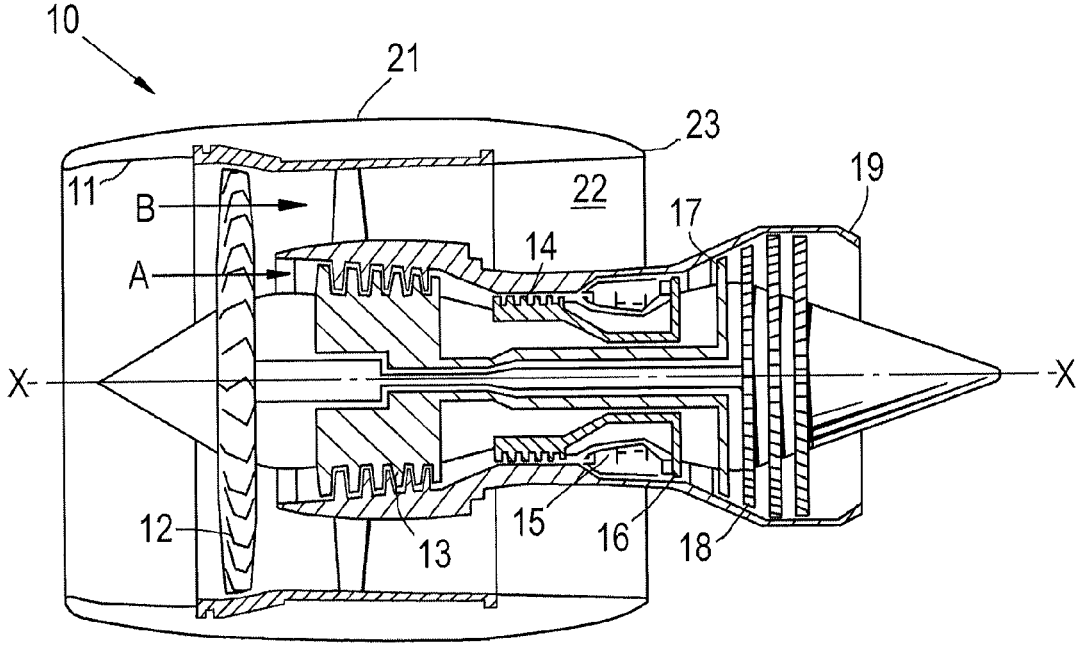
FIG. 1 shows a schematic longitudinal cross-section through a ducted fan gas turbine engine.

With reference to FIG. 1, a ducted fan gas turbine engine incorporating the invention is generally indicated at 10 and has a principal and rotational axis X-X. The engine comprises, in axial flow series, an air intake 11, a propulsive fan 12, an intermediate pressure compressor 13, a high-pressure compressor 14, combustion equipment 15, a high-pressure turbine 16, an intermediate pressure turbine 17, a low-pressure turbine 18 and a core engine exhaust nozzle 19. A nacelle 21 generally surrounds the engine 10 and defines the intake 11, a bypass duct 22 and a bypass exhaust nozzle 23.

During operation, air entering the intake 11 is accelerated by the fan 12 to produce two air flows: a first air flow A into the intermediate pressure compressor 13 and a second air flow B which passes through the bypass duct 22 to provide propulsive thrust. The intermediate pressure compressor 13 compresses the air flow A directed into it before delivering that air to the high pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines respectively drive the high and intermediate pressure compressors 14, 13 and the fan 12 by suitable interconnecting shafts.

The propulsive fan 12 includes a circumferential row of fan blades secured to a fan disc. The fan blades can be formed of polymer matrix, fibre reinforced, composite material, such as carbon fibre reinforced composite material.

Figure 2:
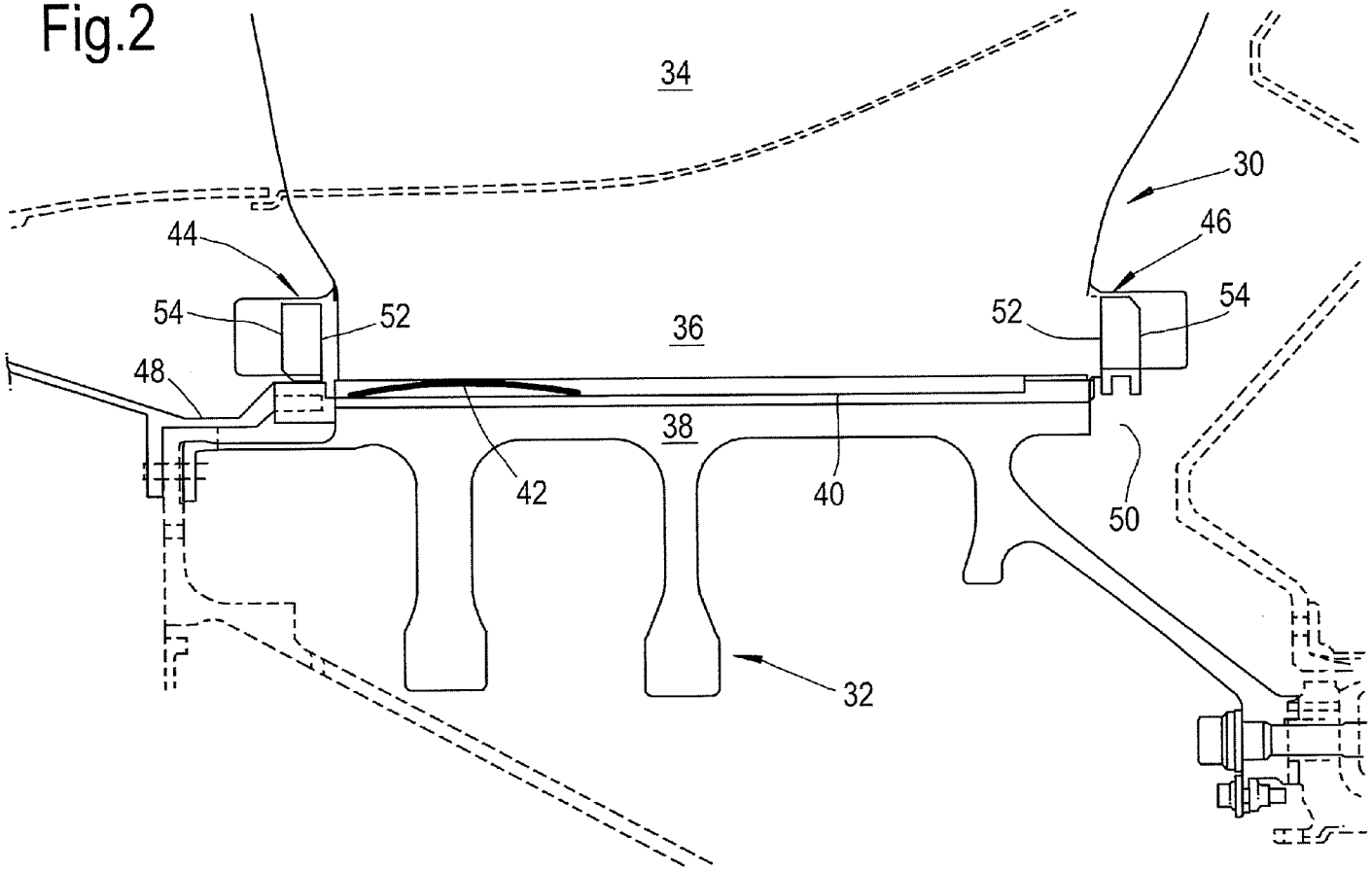
FIG. 2 shows a schematic longitudinal cross-section of the mounting region of a fan blade to a fan disc.

FIG. 2 shows a schematic longitudinal cross-section of the mounting region of one of the fan blades 30 to the fan disc 32. The blade has an aerofoil section 34 and a dovetail root 36 which is retained in a corresponding axially-extending slot in the rim 38 of the disc.

A slider 40 and spring 42 assembly is inserted into the slot at the underside of the dovetail root 36 to chock the blade 30 radially outwardly. The slider helps to prevent the spring fretting against the disc 32. It also helps to prevent the ingress of dirt into cavity beneath the dovetail root.

A trapezoidal front retainer plate 44 is located in a cavity formed at the front end of the slot to limit forward axial movement of the dovetail root 36 along the slot, and a rear trapezoidal retainer plate 46 is located in a cavity formed at the rear end of the slot to limit rearward axial movement of the dovetail root along the slot. The plates are held in place by front 48 and rear 50 support rings.

A first side 52 of each retainer plate 44, 46 is arranged for contact with the axial end face of the dovetail root 36, and an opposite second side 54 of each plate is arranged for contact with abutment surfaces of the respective cavity to limit axial movement of the root along the slot.

The two plates are formed from fibre-reinforced composite material (e.g. polymer matrix, fibre reinforced, composite material, such as carbon fibre reinforced composite material), with at least a portion of the composite material being reinforced by 3D-woven fibre tows.

Figure 3:
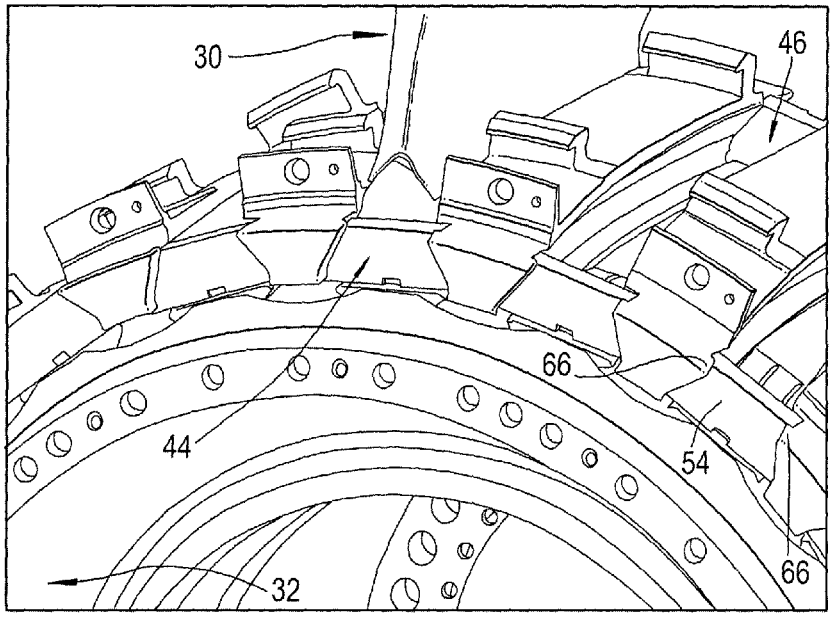
FIG. 3 shows a schematic perspective view of the front of the fan disc, and in particular a circumferential row of front retainer plates.
Figure 4:
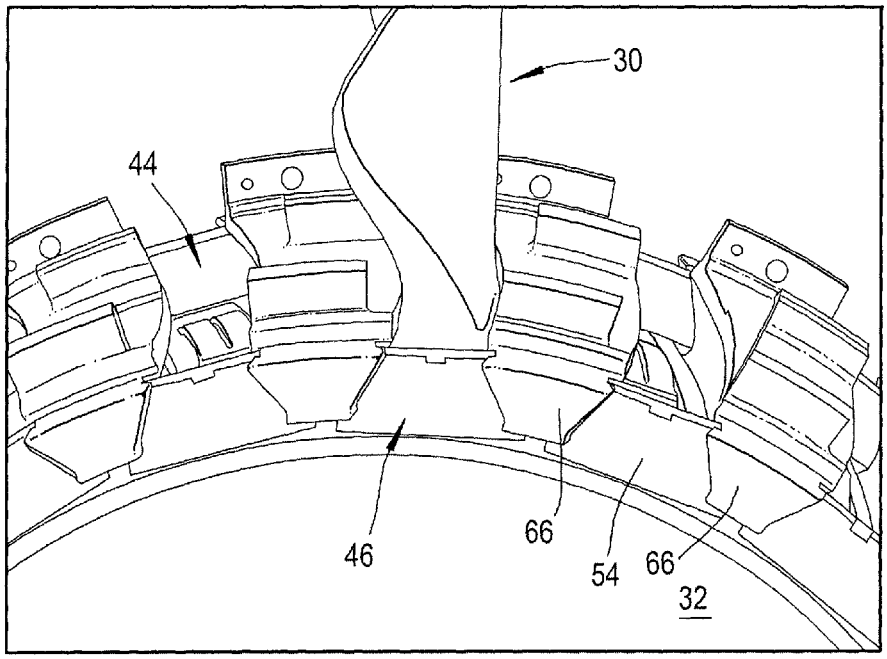
FIG. 4 shows a schematic perspective view of the rear of the fan disc, and in particular a circumferential row of rear retainer plates.

FIG. 3 shows a schematic perspective view of the front of the disc 32, and FIG. 4 shows a schematic perspective view of the rear of the disc. The cavity at each end of each dovetail root slot creates a trapezoidal space in which the respective retainer plate 44, 46 is positioned with the short parallel edge of the correspondingly trapezoidal plate being radially outwardly of the long parallel edge, and the angled edges of the trapezoidal plate being circumferentially spaced from each other. The plate is slotted into the cavity with a radially outwardly directed motion. Each cavity has a pair of projections 66 which provide the abutment surfaces for the second side 54 of the plate, the abutment surfaces extending along the angled edges of the plate.

Figure 5:
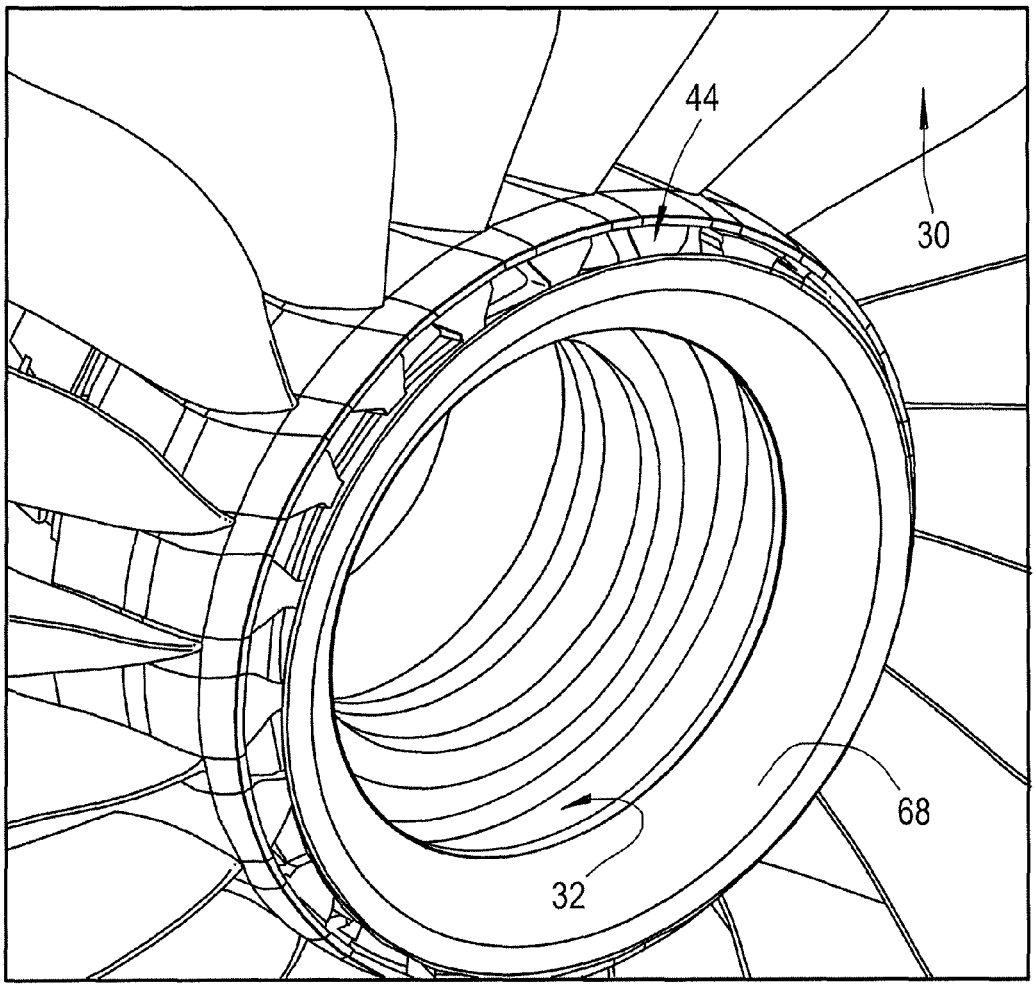
FIG. 5 shows a schematic perspective view of the front of the fan disc, and in particular a support ring for the circumferential row of front retainer plates.
Figure 6:
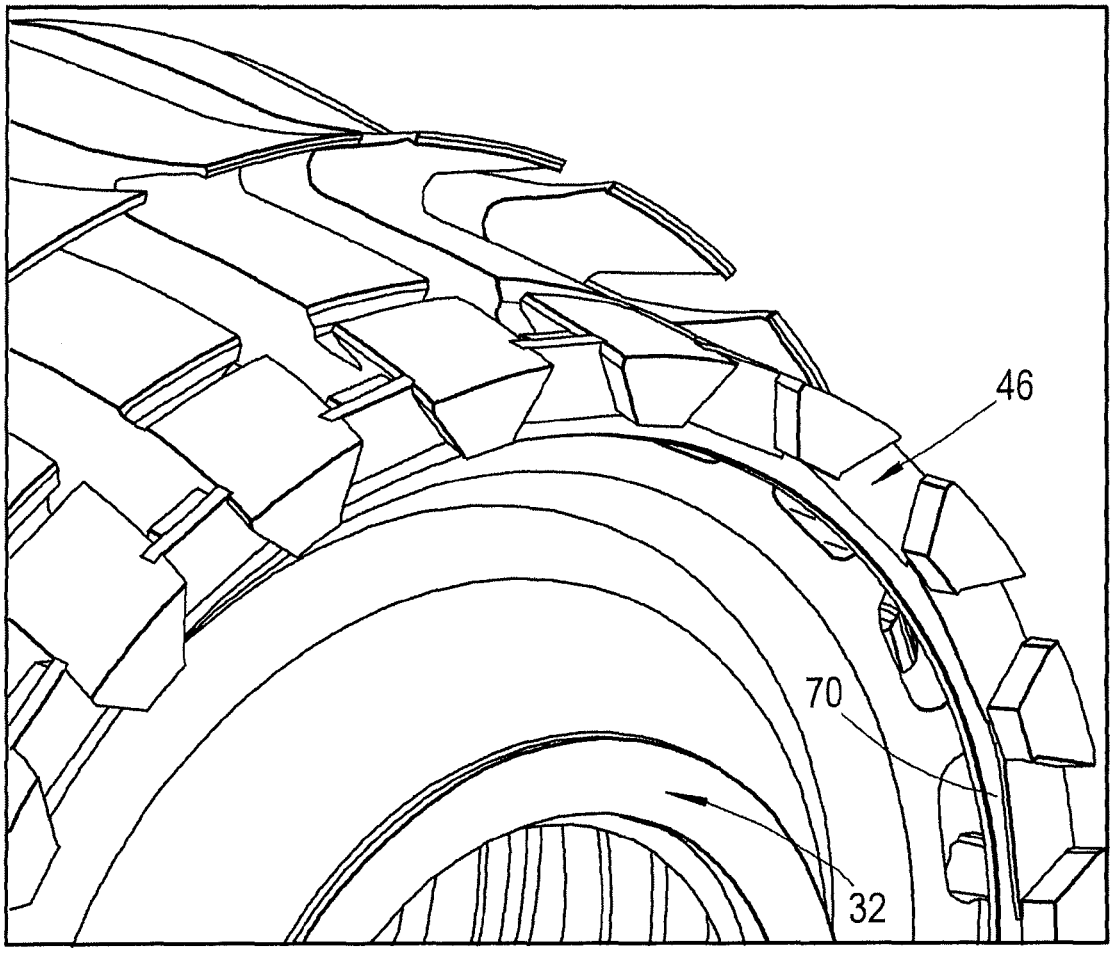
FIG. 6 shows a schematic perspective view of the rear of the fan disc, and in particular a support ring for the circumferential row of rear retainer plates.

The trapezoidal form of the retainer plates 44, 46, with the short parallel edge being located radially outwardly, keeps the plates in their cavities under centrifugal loading. However, as shown in FIGS. 5 and 6, when the engine is stationary, the plates are kept in place by front 68 and rear 70 support rings, which may be located in circumferentially extending grooves formed in the radially inward edges of the plates.

Figure 7A:
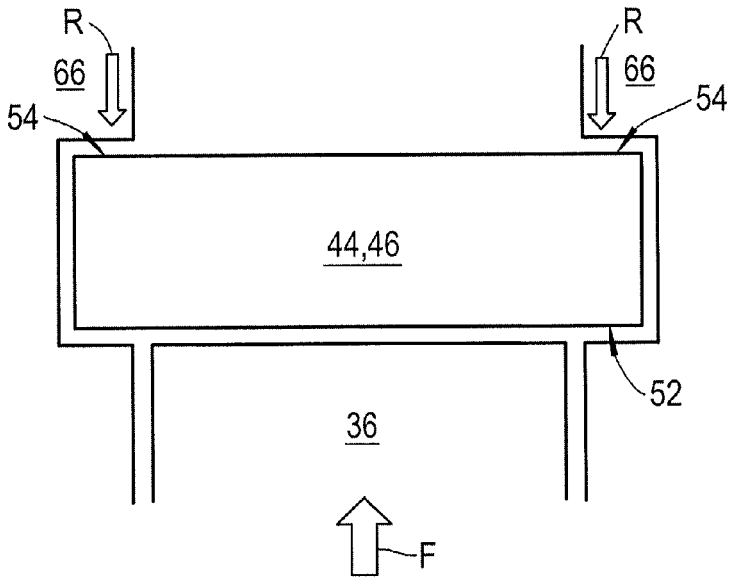
FIG. 7 shows (a) a schematic constant radius section through one of the retainer plates, and (b) a further schematic constant radius section through the plate illustrating different stress states.
Figure 7B:
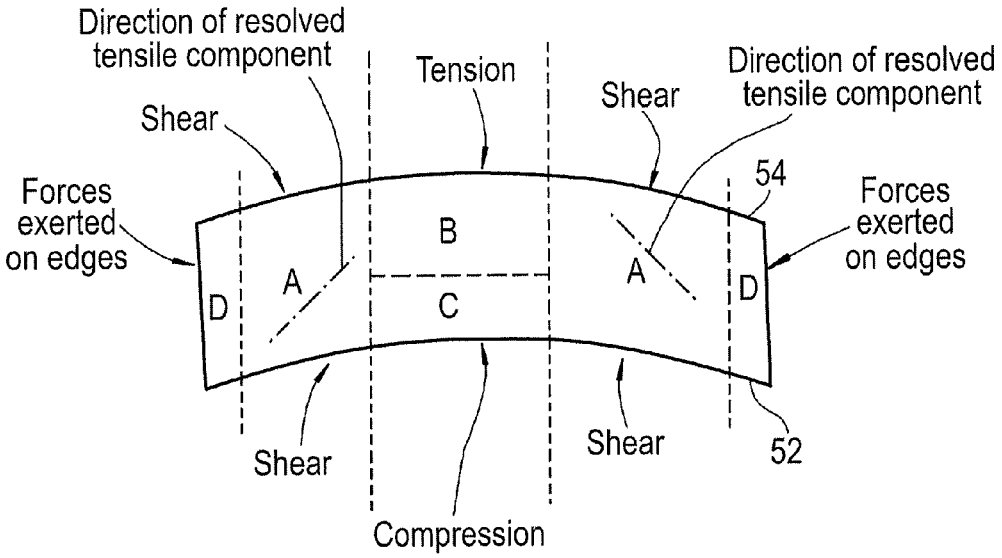

FIG. 7(*a*) shows a schematic constant radius section through one of the retainer plates 44, 46. The plate experiences an axial force F at the centre of its first side 52 from loading contact with the dovetail root 36 of the fan blade, and opposing axial reaction forces R at the circumferentially spaced edges of its second side 54 from contact with the abutment surfaces of the projections 66.

FIG. 7(*b*) is a further schematic constant radius section through the plate illustrating different stress states caused by the forces and constraints to which the plate is exposed. Thus the axial force F and reaction forces R produce a 3-point loading situation which generates in-plane compressive stresses at the centre of the first side 52 and in-plane tensile stresses at the centre of the second side 54. At the edges of the plate, physical constraints and the reaction forces R generate locally high stress concentrations, particularly at the second side 54. Between these central stresses and edge stresses, the loading on the plate has a high shear component.

It is then possible to define different plate zones based on the types of forces and constraints to which the plate is exposed. A first zone of the plate extends through the thickness of the plate from a region on the first side 52 which contacts with the axial end face of the dovetail root. This zone can be sub-divided into a portion C at the first side 52 which experiences high in-plane compressive stresses, and a portion B at the second side 54 which experiences high in-plane tensile stresses. Two second zones D of the plate extend through the thickness of the plate from respective edge regions on the second side 54 which contact with the abutment surface of the cavity. Two third zones A extend through the thickness of the plate and separate the first zone from a respective one of the second zones, the third zones experiencing high shear stresses.

To enhance the ability to vary the alignment of reinforcing fibres in different parts of the plate depending on the expected stress pattern in the plate, the fibre tows of the composite material of the plate are 3D-woven into a preform, which is then used to form the final composite material.

In particular, to resist the shear stresses in the third zones A, the composite material of these zones, which is reinforced by warp and weft fibre tows extending in layers parallel to the plane of the plate (i.e. perpendicularly to the engine axial direction), is also reinforced by angle interlock fibre tows which extend through the thickness of the plate. For example, around 50% of the total number of tows in the third zones can be angle interlock tows. These tows can be angled relative to the axial direction to best resist the shear stresses. In particular, the shear stresses produced in the right hand zone A of FIG. 7(*b*) will have their resolved tensile component at an angle of about 45° to the axial direction in the plane of the drawing. The angle interlock tows in this zone can thus be at this angle, aligned with the direction of this component (indicated in FIG. 7(*b*) by a dash-dotted line). The angle interlock tows in the left hand zone A can similarly be at an angle of about 45° to the axial direction, also aligned along the direction of the resolved tensile component of the shear stress.

In the second zones D, the warp and weft fibre tows extending parallel to the plane can be supplemented by, for example, about 10% of layer-to-layer interlock fibre tows which help to prevent inter-layer delamination and edge splitting, which can be a particular problem when the edges of the plate are trimmed in a final manufacturing step.

Similarly, in portion C of the first zone, the warp and weft fibre tows extending parallel to the plane can be supplemented by, for example, about 10% of layer-to-layer interlock fibre tows. These also help to prevent inter-layer delamination, in this case caused by the high in-plane compressive stresses generated in portion C. In practice, the woven pre-form can be cut from a larger 3D-woven shape, with the periphery of the cut pre-form being somewhat beyond the targeted component dimensions to allow for subsequent edge trimming. The pre-form may be placed in a mould where resin is added in a resin infusion process (such as resin transfer moulding), and then cured in mould. After removal from the mould, it can be trim machined to the final shape.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

All references referred to above are hereby incorporated by reference.

The invention claimed is:

1. A retainer plate for retaining a dovetail root of a fan blade of a gas turbine engine in a corresponding axially-extending slot in the rim of a fan disc, in use, the plate locating in a cavity formed at an end of the slot such that a first side of the plate is arranged for contact with an axial end face of the dovetail root and an opposite second side of the plate is arranged for contact with an abutment surface of the cavity to limit axial movement of the root along the slot;

wherein the retainer plate is formed from fibre-reinforced composite material, at least a portion of the composite material being reinforced by 3D-woven fibre tows, and the retainer plate has:

a first zone which extends through the thickness of the plate from a region on the first side which contacts with the axial end face of the dovetail root, a second zone which extends through the thickness of the plate from a region on the second side which contacts with the abutment surface of the cavity, and a third zone which extends through the thickness of the plate and separates the first zone from the second zone;

wherein the composite material of the first to third zones is reinforced by warp and weft fibre tows which extend in layers parallel the plane of the plate, and the third zone is also reinforced by angle interlock fibre tows which extend through the thickness of the plate.

2. A retainer plate according to claim 1, wherein, viewing the plate along the radial direction, the angle interlock fibre tows are angled at between 30° and 60° to the axial direction.

3. A retainer plate according to claim 1, wherein the angle interlock fibre tows are at least 25% and at most 75% of the total number of tows in the third zone.

4. A retainer plate according to claim 1, wherein the second zone is also reinforced by layer-to-layer interlock fibre tows.

5. A retainer plate according to claim 4, wherein the layer-to-layer interlock fibre tows are at least 2% and at most 20% of the total number of tows in the second zone.

6. A retainer plate according to claim 1, wherein a portion of the first zone at the first side of the retainer plate is also reinforced by layer-to-layer interlock fibre tows.

7. A retainer plate according to claim 6, wherein the layer-to-layer interlock fibre tows are at least 2% and at most 20% of the total number of tows in this portion of the first zone.

8. A retainer plate according to claim 1, wherein the cavity has a pair of abutment surfaces which extend along respective circumferentially-spaced edges of the retainer plate, and the retainer plate has two second zones, each second zone being located at a respective one of the edges.

9. A retainer plate according to claim 8, wherein the first zone is centrally located relative to the second zones, and the retainer plate has two third zones, each third zone separating the first zone from a respective one of the second zones.

10. A retainer plate according to claim 1, wherein the composite material is carbon fibre-reinforced, polymer matrix composite material.

11. A fan assembly of a gas turbine engine, the assembly having:

a fan disc;

a circumferential row of fan blades, each fan blade having a dovetail root which is retained in a corresponding axially-extending slot in the rim of the fan disc; and a circumferential row of first retainer plates according to claim 1;

wherein each first retainer plate is located in a cavity formed at an end of a respective one of the slots such that the first side of the first retainer plate is arranged for contact with an axial end face of the respective dovetail root and the opposite second side of the first retainer plate is arranged for contact with an abutment surface of the cavity to limit axial movement of the root along the slot.

12. A fan assembly according to claim 11 which further has:

a circumferential row of second retainer plates;

wherein each second retainer plate is located in a cavity formed at an opposite end of a respective one of the slots such that the first side of the second retainer plate is arranged for contact with an axial end face of the respective dovetail root and the opposite second side of the second retainer plate is arranged for contact with an abutment surface of the cavity to limit axial movement of the root along the slot.

13. A fan assembly according to claim 11, wherein at least the dovetail roots of the fan blades are formed of polymer matrix, fibre reinforced, composite material.

14. A gas turbine engine having the fan assembly of claim 11.

* * * * *